US011735128B2

(12) United States Patent
Watsuda

(10) Patent No.: US 11,735,128 B2
(45) Date of Patent: Aug. 22, 2023

(54) DRIVING METHOD FOR DISPLAY DEVICE

(71) Applicant: Innolux Corporation, Miao-Li County (TW)

(72) Inventor: Hirofumi Watsuda, Miao-Li County (TW)

(73) Assignee: Innolux Corporation, Miaoli County (TW)

( * ) Notice: Subject to any disclaimer, the term of this patent is extended or adjusted under 35 U.S.C. 154(b) by 126 days.

(21) Appl. No.: 17/206,134

(22) Filed: Mar. 19, 2021

(65) Prior Publication Data

US 2022/0301103 A1 Sep. 22, 2022

(51) Int. Cl.

| | |
|---|---|
| ***G09G 3/36*** | (2006.01) |
| ***G09G 3/3233*** | (2016.01) |
| ***G09G 3/20*** | (2006.01) |

(52) U.S. Cl.

CPC ..... *G09G 3/3607* (2013.01); *G09G 3/3233* (2013.01); *G09G 3/2022* (2013.01)

(58) Field of Classification Search

None

See application file for complete search history.

(56) References Cited

U.S. PATENT DOCUMENTS 5,990,629 A * 11/1999 Yamada ..... G09G 3/2077 315/169.3
9,792,857 B2 * 10/2017 Li ..... G09G 3/2081
10,127,856 B2 * 11/2018 Lee ..... G09G 3/2037
2002/0053884 A1 * 5/2002 Kimura ..... G09G 3/3233 315/169.3
2004/0189214 A1 * 9/2004 Osame ..... H01L 51/5296 315/169.3
2006/0267889 A1 * 11/2006 Kimura ..... G09G 3/3258 345/84
2008/0088560 A1 * 4/2008 Bae ..... G09G 3/2081 345/90
2008/0136761 A1 * 6/2008 Hong ..... G09G 3/2022 345/89
2009/0267881 A1 * 10/2009 Takaki ..... G09G 3/3648 345/89

(Continued)

FOREIGN PATENT DOCUMENTS

| | | |
|---|---|---|
| CN | 107767811 | 3/2018 |
| EP | 2299427 | 3/2011 |
| EP | 3594932 | 1/2020 |

OTHER PUBLICATIONS

"Search Report of Europe Counterpart Application", dated Jul. 12, 2022, pp. 1-8.

*Primary Examiner* — Dorothy Harris
(74) *Attorney, Agent, or Firm* — JCIPRNET

(57) ABSTRACT

A driving method adapted to drive a first pixel of a display device to display an image in a frame time is provided. The driving method includes dividing the frame time into a first sub-frame time and a second sub-frame time; providing a first data with a first gray level; and controlling the first pixel to be emitted in the first sub-frame time or in the second sub-frame time according to the first data. When the first gray level is greater than a predetermined gray level, controlling the first pixel to be emitted in the first sub-frame time, and when the first gray level is less than or equal to the predetermined current level, controlling the first pixel to be emitted in the second sub-frame time.

13 Claims, 16 Drawing Sheets

(56) References Cited

U.S. PATENT DOCUMENTS

| | | | | |
|---|---|---|---|---|
| 2013/0201223 | A1* | 8/2013 | Li | G09G 3/3225 345/77 |
| 2015/0042703 | A1* | 2/2015 | Chaji | G09G 3/3233 345/694 |
| 2016/0217754 | A1* | 7/2016 | Bae | G09G 3/3614 |

* cited by examiner

100

| D1 | Current | Current |
|---|---|---|
| Lv0 | Lv0 | Lv0 |
| Lv31 | Lv0 | Lv125 |
| Lv63 | Lv0 | Lv255 |
| Lv64 | Lv64 | Lv0 |
| Lv127 | Lv127 | Lv0 |
| Lv191 | Lv191 | Lv0 |
| Lv255 | Lv255 | Lv0 |

DRIVING METHOD FOR DISPLAY DEVICE

BACKGROUND

1. Technical Field

The subject disclosure generally relates to a driving method, and more particularly, relates to a driving method for a display device.

2. Description of Related Art

In display devices, such as light emitting diode (LED) displays, a desired gray level is usually displayed by the LED by providing a corresponding current or voltage thereto. However, some LED have unstable light emitting characteristics. For example, in low driving current condition, LED has lower light emitting efficiency, which results in color difference in displaying data with low gray level. Therefore, there is necessity to improve such problem.

SUMMARY

Accordingly, some embodiments of the disclosure are directed to a driving method to improve display quality. A frame time is divided into a first sub-frame time and a second sub-frame time. A first data with a first gray level is provided. The first pixel is controlled to be emitted in the first sub-frame time or in the second sub-frame time according to the first data. When the first gray level is greater than a predetermined gray level, the first pixel is controlled to be emitted in the first sub-frame time, and when the first gray level is less than or equal to the predetermined current level, the first pixel is controlled to be emitted in the second sub-frame time.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
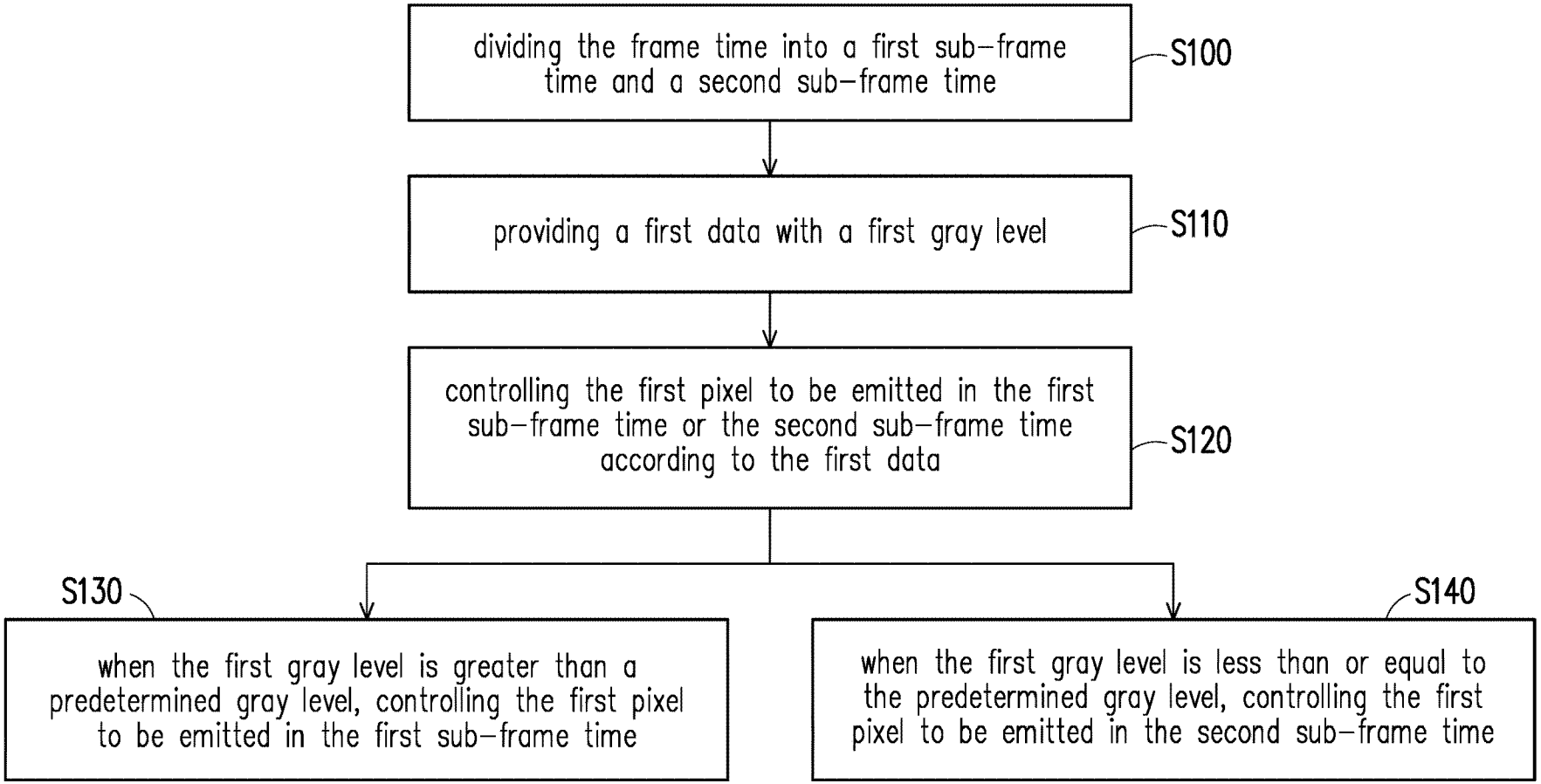
FIG. 1 is a flow chart of a driving method according to an embodiment of the subject disclosure.

The following embodiments when read with the accompanying drawings are made to clearly exhibit the above-mentioned and other technical contents, features and/or effects of the present disclosure. Through the exposition by means of the specific embodiments, people would further understand the technical means and effects the present disclosure adopts to achieve the above-indicated objectives. Moreover, as the contents disclosed herein should be readily understood and can be implemented by a person skilled in the art, all equivalent changes or modifications which do not depart from the concept of the present disclosure should be encompassed by the appended claims.

Certain terms are used throughout the description and following claims to refer to particular components. As one skilled in the art will understand, electronic equipment manufacturers may refer to a component by different names. This document does not intend to distinguish between components that differ in name but not function.

In the following description and in the claims, the terms "include", "comprise" and "have" are used in an open-ended fashion, and thus should be interpreted to mean "include, but not limited to . . . ".

It will be understood that when an element or layer is referred to as being "on" or "connected to" another element or layer, it can be directly on or directly connected to the other element or layer, or intervening elements or layers may be presented. In contrast, when an element is referred to as being "directly on" or "directly connected to" another element or layer, there are no intervening elements or layers presented.

It should be understood that, although the terms first, second, third etc. may be used herein to describe various elements, components, regions, layers, portions and/or sections, these elements, components, regions, layers, portions and/or sections should not be limited by these terms. These terms are only used to distinguish one element, component, region, layer, portion or section from another region, layer or section. Thus, a first element, component, region, layer, portion or section discussed below could be termed a second element, component, region, layer, portion or section without departing from the teachings of the present disclosure.

The terms "about" and "substantially" typically mean +/−10% of the stated value, more typically +/−5% of the stated value, more typically +/−3% of the stated value, more typically +/−2% of the stated value, more typically +/−1% of the stated value and even more typically +/−0.5% of the stated value. The stated value of the present disclosure is an approximate value. When there is no specific description, the stated value includes the meaning of "about" or "substantially."

Furthermore, the terms recited in the specification and the claims such as "connect" or "couple" is intended not only directly connect with other element, but also intended indirectly connect and electrically connect with other element.

In addition, the features in different embodiments of the present disclosure can be mixed to form another embodiment.

Figure 2:
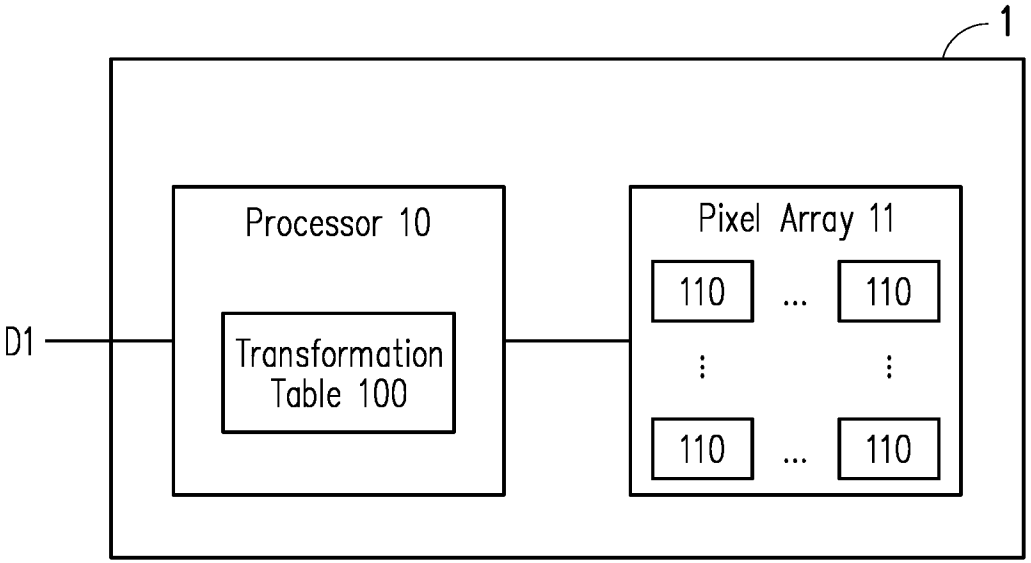
FIG. 2 illustrates a display device according to an embodiment of the subject disclosure.

FIG. 1 is a flow chart of a driving method according to an embodiment of the subject disclosure. FIG. 2 illustrates a display device 1 according to an embodiment of the subject disclosure. The driving method of FIG. 1 can be implemented by the display device 1 shown in FIG. 2. Referring to FIG. 2, the display device 1 includes a processor 10 and a pixel array 11. The pixel array 11 includes a plurality of pixels 110. The processor 10 is electrically connected to at least one pixel 110 in the pixel array 11. According to some embodiments, the driving method is implemented on the driving device 1, so the processor 10 can control display of the pixel array 11. A lookup table 100 can be stored in the processor 10. The pixel 110 can include a light emitting element. The light emitting element can be a light emitting diode (LED), a micro LED, a mini LED, an OLED (organic light emitting diode), or mixtures thereof. The display device 1 can be a light emitting diode display, a micro LED display, a mini LED display, an OLED display, or an LCD display.

Figure 3A:
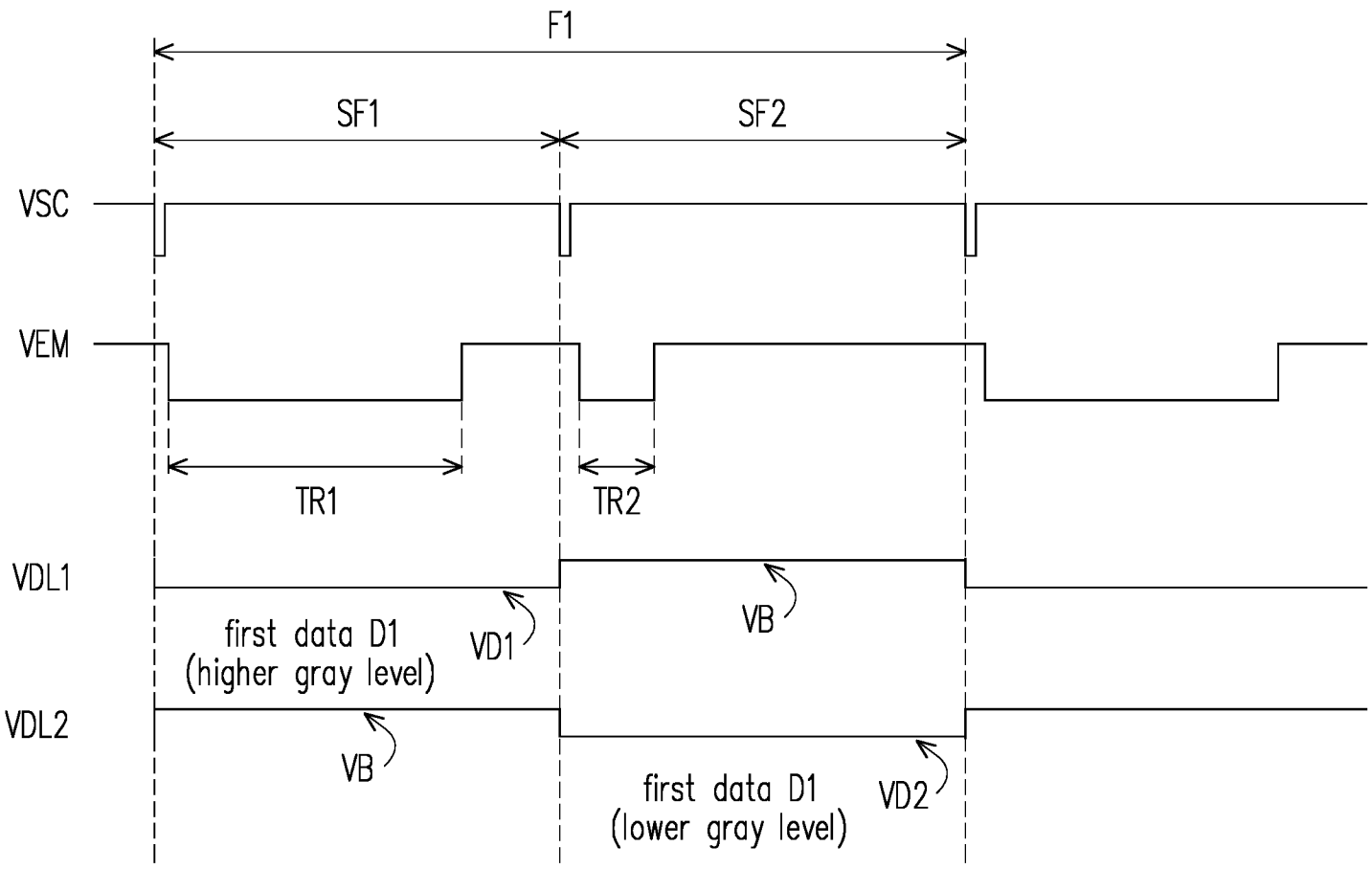
FIG. 3A illustrates a driving waveform of the driving method according to an embodiment.

FIG. 1 is a flow chart of a driving method according to an embodiment of the subject disclosure. FIG. 3A illustrates a driving waveform of the driving method illustrated in FIG. 1 according to an embodiment of the subject disclosure. Referring to FIG. 1 and FIG. 3A, the display device 1 may display an image in a frame time F1. Specifically, the driving method can be adapted to drive a pixel of the display device 1 for the pixel array 11 to display an image in the frame time F1. In step S100, the frame time F1 is divided into a first sub-frame time SF1 and a second sub-frame time SF2. According to some embodiments, the first sub-frame time SF1 is before the second sub-frame time SF2. In step 110, a first data D1 with a first gray level is provided. In step 120, the pixel is controlled to be emitted in the first sub-frame time SF1 or in the second sub-frame time SF2 according to the first data D1. In step 130, when the first gray level is greater than a predetermined gray level, the pixel is controlled to be emitted in the first sub-frame time SF1. In step 140, when the first gray level is less than or equal to the predetermined current level, the pixel is controlled to be emitted in the second sub-frame time SF2.

Figures 3B, 3C:
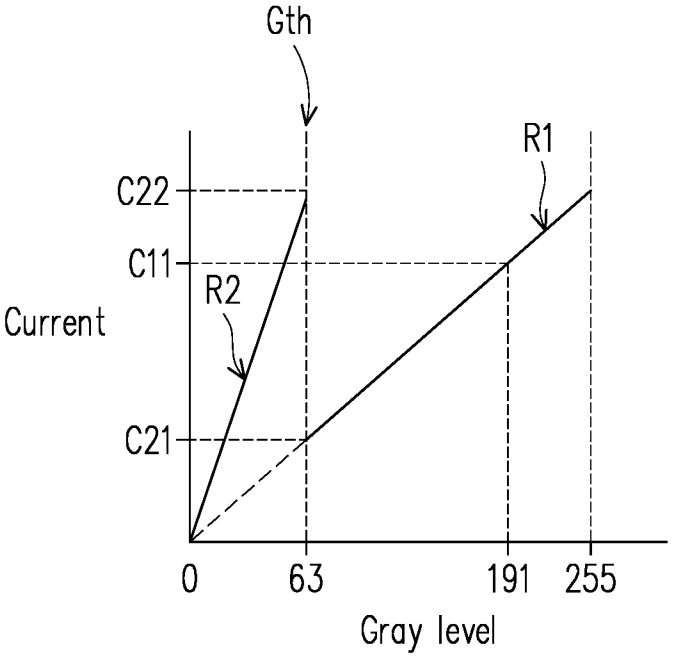
FIG. 3B illustrates the relation between the current and the gray level according to an embodiment of the subject disclosure.
FIG. 3C illustrates a lookup table according to an embodiment of the subject disclosure.

FIG. 3B illustrates a relation between the current and the gray level according to an embodiment of the subject disclosure. FIG. 3C illustrates a lookup table 100 according to an embodiment of the subject disclosure. The lookup table 100 can be stored in the processor 10, for example. The processor 10 may receive the first data D1. In such example, the values of 0-255 represent gray levels the first data D1 corresponds to, which should not be construed as actual voltage or current values applied to the driving the pixel 110. People having ordinary skill in the art can alter or modify correlations of the data stored in the lookup table 100 based on different design concepts and system requirement. For example, the correlation between the data and the gray level can also include mura effect calibration. In such embodiment of the lookup table 100, minimum and maximum gray levels are respectively 0 and 255, and the predetermined gray level Gth can be 63, for example. The first column of the lookup table 100 includes part of the first gray levels that the first data D1 corresponds to. The second and third columns include current levels provided to the pixel in the first sub-frame time SF1 and the second sub-frame time SF2.

FIG. 3B shows two conversion relation curves R1, R2 regarding the relation between the current level and the gray level, which, for example, can be linear relation, but the subject disclosure is not limited herein. As shown in FIG. 3B, the first conversion relation R1 and the second conversion relation R2 are different. When the first gray level corresponding to the first data D1 is greater than the predetermined gray level Gth, the conversion relation curve R2 is applied, so a current level corresponding to the first gray level is provided to the pixel according to the conversion relation curve R2. When the first gray level corresponding to the first data D1 is less than or equal to the predetermined gray level Gth, the conversion relation curve R1 is applied, so a current level corresponding to the first gray level is provided to the pixel according to the conversion relation curve R1. According to some embodiments, the second conversion relation R2 may have greater slope than the first conversions relation R1.

When the first gray level of the first data D1 is greater than the predetermined gray level Gth (for example, 63), the corresponding current level (the first current level) according to the first conversion relation R1 is high enough to provide good light emitting efficiency. Therefore, according to some embodiments, when the first gray level of the first data D1 is greater than the predetermined gray level Gth, a first current level corresponding to the first gray level according to the first conversion relation R1 is provided to the pixel in the first sub-frame time SF1. Specifically, for example, when the first gray level is 191 (greater than 63), a first current level C11 corresponding to the gray level 191 according to the first conversion relation R1 can be provided to the pixel in the first sub-frame time SF1, as shown in the lookup table 100 in FIG. 3C. In addition, for ease of explanation, the predetermined gray level Gth 63 is only an example, and the subject disclosure is not limited thereto.

However, according to the conversion relation R1, when the gray level is low (for example, lower than the predetermined gray level Gth), the corresponding current level according to the first conversion relation R1 is low. Since light emitting elements usually have unstable display characteristics when the driving current is low, driving the pixel with relatively low current may resulted in severe chromatic aberration. Therefore, according to some embodiments, when the first gray level of the first data is less than or equal to the predetermined current level, a second current level corresponding to the first gray level according to another conversion relation, for example, the second conversion relation R2, can be provided to the pixel in the second sub-frame time SF2. For example, when the gray level is less than or equal to the predetermined gray level Gth, for example, gray level 63, the current C21 corresponding to gray level 63 according to the first conversion relation R1 may be too low where emitting characteristics are usually unstable. According to some embodiment, in the lower gray level condition, the current following the second conversion relation R2, in order to obtain higher current, may be provided to the pixel. Specifically, when the gray level is less than or equal to the predetermined gray level Gth, for example, gray level 63, a second current level C22 corresponding to the first gray level according to the second conversion relation R2 can be provided to the pixel in the second sub-frame time SF2. As shown in FIG. 3B, for gray level 63, the current C22 (the second current level) according to the second conversion relation R2 is greater than the current C21 according to the first conversion relation R1. For example, as shown in FIG. 3B and the third column in FIG. 3C, the current C22 corresponding to gray level 63 according to the second conversion relation R2 may be the same as the current level corresponding to gray level 255 according to the first conversion relation R1, but this invention is not limited thereto.

According to some embodiments, the pixel can be controlled to be emitted for the second emission period TR2 in the second sub-frame time SF2, and a time length of the first emission period TR1 and a time length of the second emission period TR2 can be different. According to some embodiments, for the same gray level, the current level C22 according to the second conversion relation R2 can be greater than the current level C21 according to the first conversion relation R1. According to some embodiments, to ensure the brightness, the pixel can be driven by the second current level C22 with a shorter emission period. That is, the time length of the second emission period TR2 can be shorter than the time length of the first emission period TR1.

According to some embodiments, the time length of the first emission period TR1 can be greater than the time length of the second emission period TR2. For example, the time length of the first emission period TR1 can be multiple times as the time length of the second emission period TR2, for example, the multiple times can be in the range of 1.5 to 8, in the range of 2 to 6, in the range of 3 to 5, or in the range 3.5 to 4.5.

The mean brightness intensity is approximately determined by the product of driving current and emission time for light emitting device. Therefore, the current level C22 of the second conversion relation R2 can be designed corresponding to the current level C21 of the first conversion relation R1 and the ratio between the length of the first emission period TR1 and the length of the second emission period TR2. For example, in the case that the time length of the second emission period TR2 is ¼ of the length of the first emission period TR1, the current level C22 can be designed as 4 times of the current level C21. The ratio between the length of the first emission period TR1 and the length of the second emission period TR2 can be determined as desired according to the target current level in low gray level.

The gray level expressed by the pixel conforms the following equation:

$$\text{Displayed Gray Level} = \text{Driving Current} \times \text{Length of Emission Period.}$$

Therefore, when the first gray level of the first data D1 is greater than the predetermined gray level Gth, the pixel is controlled to be emitted for the longer first emission period TR1 in the first sub-frame time SF1. When the first gray level of the first data D1 is less than or equal to the predetermined gray level Gth, the pixel is controlled to be emitted for the shorter second emission period TR2 in the second sub-frame time SF2.

In one embodiment, the slope of the conversion relation curve R2 may be approximately four times than the slope of the conversion relation curve R1. Correspondingly, the second emission period TR2 may be approximately a quarter to the first emission period TR1. That is, the processor 10 may control the pixel 110 to be emitted in the first sub-frame time SF1 according to the conversion relation curve R2 to express a gray level greater than the predetermined gray level Gth, and the processor 10 may control the pixel 110 to be emitted in the first sub-frame time according to the conversion relation curve R1 to express a gray level less than or equal to the predetermined gray level Gth. As a result, the display device 1 may effectively avoid driving the pixel 110 with relatively low current levels.

In brief, according to some embodiments, the display device 1 divides the frame time F1 into the first sub-frame time SF1 and the second sub-frame time SF2, which have different length of emission periods. The pixel 110 is controlled to be displayed in one of the first sub-frame time SF1 and the second sub-frame time SF2 of the frame time F1. When the processor 10 determines the first gray level corresponding to the first data D1 is greater than the predetermined gray level Gth, a first current level is provided to the pixel in the first sub-frame time SF1 for the first emission period TR1, and the first current level corresponds to the first gray level according to the conversion relation R1. When the processor determines the first gray level corresponding to the first data D1 is less than or equal to the predetermined gray level Gth, the second current level corresponding to the second conversion relation R2 can be provided to the pixel in the second sub-frame time SF2 for the second emission period TR2. In some embodiments, the time length of the second emission period TR2 can be shorter than the time length of the first emission period TR1.

Thus, according to some embodiments, when the gray level of the data is less than or equal to a predetermined gray level Gth, the current level can follow the second conversion relation R2 to result in higher current level, and the higher current level can be provided to the pixel in the second sub-frame time for a shorter length of emission period. Thus, display image quality of the display device in low gray level can be effectively improved.

Figure 3D:
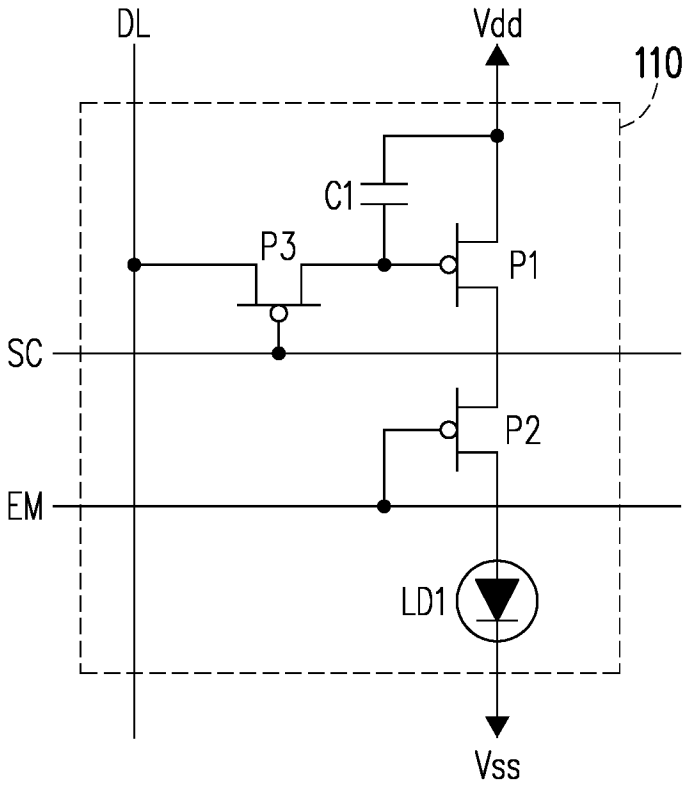
FIG. 3D illustrates a pixel according to an embodiment of the subject disclosure.

FIG. 3D illustrates a pixel 110 according to an embodiment of the subject disclosure. The pixel 110 may be disposed in the pixel array 11 as illustrated in FIG. 1. The pixel 110 includes transistors P1, P2, P3, a light emitting diode (LED) LD1 and a capacitor C1. The transistors P1, P2 and the LED LD1 are serially connected between a first reference voltage Vdd and a second reference voltage Vss. In such embodiment, the transistor P1 is directly connected to the first reference voltage Vdd, the LED LD1 is directly connected to the second reference voltage Vss, and the transistor P2 is connected between the transistor P1 and the LED LD1. The transistor P3 is connected between a data line DL and a control terminal of the transistor P1. A scan line SC is connected to a control terminal of the transistor P3. An emission line EM is connected to a control terminal of the transistor P2. The capacitor C1 is connected between the first reference voltage Vdd and a control terminal of the transistor P1.

Referring to FIG. 3A and 3D, signals VSC and VEM are voltage signals transmitted on the scan line SC and the emission line EM respectively. A Signal VDL1 is a voltage signal transmitted on the data line DL when the first gray level is determined to be greater than the predetermined gray level Gth. A Signal VDL2 is a voltage signal transmitted on the data line DL when the first gray level is determined to be less than or equal to the predetermined gray level Gth.

As can be seen in FIG. 3A, the frame time F1 is divided in to the first sub-frame time SF1 and the second sub-frame time SF2. At beginnings of the first sub-frame time SF1 and the second sub-frame time SF2, the signal VSC is switched to a low voltage level and the transistor P3 is conducted, so the data transmitted from the data line DL is stored in the capacitor C1. Then, the signal VEM is switched to the low voltage level within a first emission period TR1 and a second emission period TR2 and the transistor P2 is conducted, so the LED LD1 is driven by the transistor P1 according to data stored in the capacitor C1. In other words, the first emission period TR1 and the second emission period TR2 are respectively the emission periods of the first sub-frame time SF1 and the second sub-frame time SF2.

Referring to FIG. 3A and 3C, when the first gray level is greater than a predetermined gray level Gth, the first driving voltage VD1 is provided to the pixel in the first sub-frame time SF1, where the transistor P1 is controlled by the first driving voltage VD1 to provide the first current level corresponding to the first data D1 according to the second conversion relation curve R2. Therefore, by driving the LED LD1 with the first current level for the first emission period TR1, the first gray level may be expressed by the pixel. A black data to let the light emitting device turned off can be provided to the first pixel in the second sub-frame time SF2. Specifically, a black driving voltage VB can be provided to the pixel in the second sub-frame time SF2, so the transistor P1 may provide a black driving current to the LED LD1 in the second sub-frame time SF2. The LED LD1 may be cutoff according to the black driving current. More concretely, when the first gray level is 191, the original first current level corresponding to gray level 191 is provided to the pixel in the first sub-frame time SF1, and the black driving voltage VB can be provided to the pixel in the second sub-frame time SF2.

When the first gray level is less than or equal to the predetermined gray level Gth (for example, 63), a second driving voltage VD2 is provided to the pixel in order to provide the second current level C22 corresponding to the first gray level 63 according to the second conversion relation R2 in the second sub-frame time SF2. By driving the LED LD1 with the second current level for the first emission period TR2, the second gray level may be expressed by the pixel. The black driving voltage VB can be provided to the pixel in the first sub-frame time SF1 to control the LED LD1 to be cutoff.

Figure 4A:
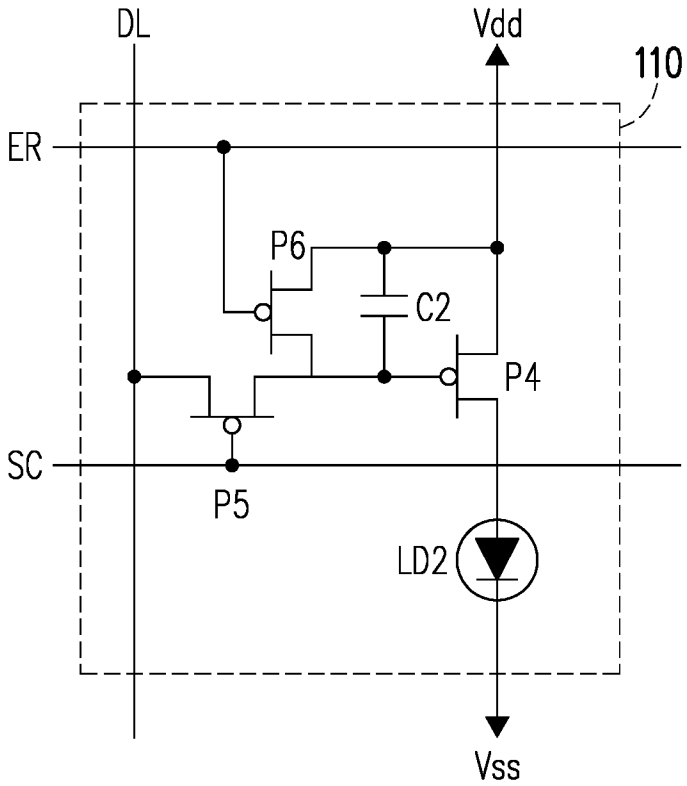
FIG. 4A illustrates another pixel according to an embodiment of the subject disclosure.

FIG. 4A illustrates another pixel 110 according to an embodiment of the subject disclosure. The pixel 110 includes transistors P4, P5, P6, a light emitting diode (LED) LD2 and a capacitor C2. The transistors P4 and the LED LD2 are serially connected between a first reference voltage Vdd and a second reference voltage Vss. In such embodiment, the transistor P4 is directly connected to the first reference voltage Vdd, the LED LD2 is directly connected to the second reference voltage Vss. The transistor P5 is connected between a data line DL and a control terminal of the transistor P4. A scan line SC is connected to a control terminal of the transistor P5. The transistor P6 is connected between the first reference voltage Vdd and the control terminal of the transistor P4. A control terminal of the transistor P6 is connected to an erase line ER. The capacitor C2 is connected between the first reference voltage Vdd and the control terminal of the transistor P4.

Figure 4B:
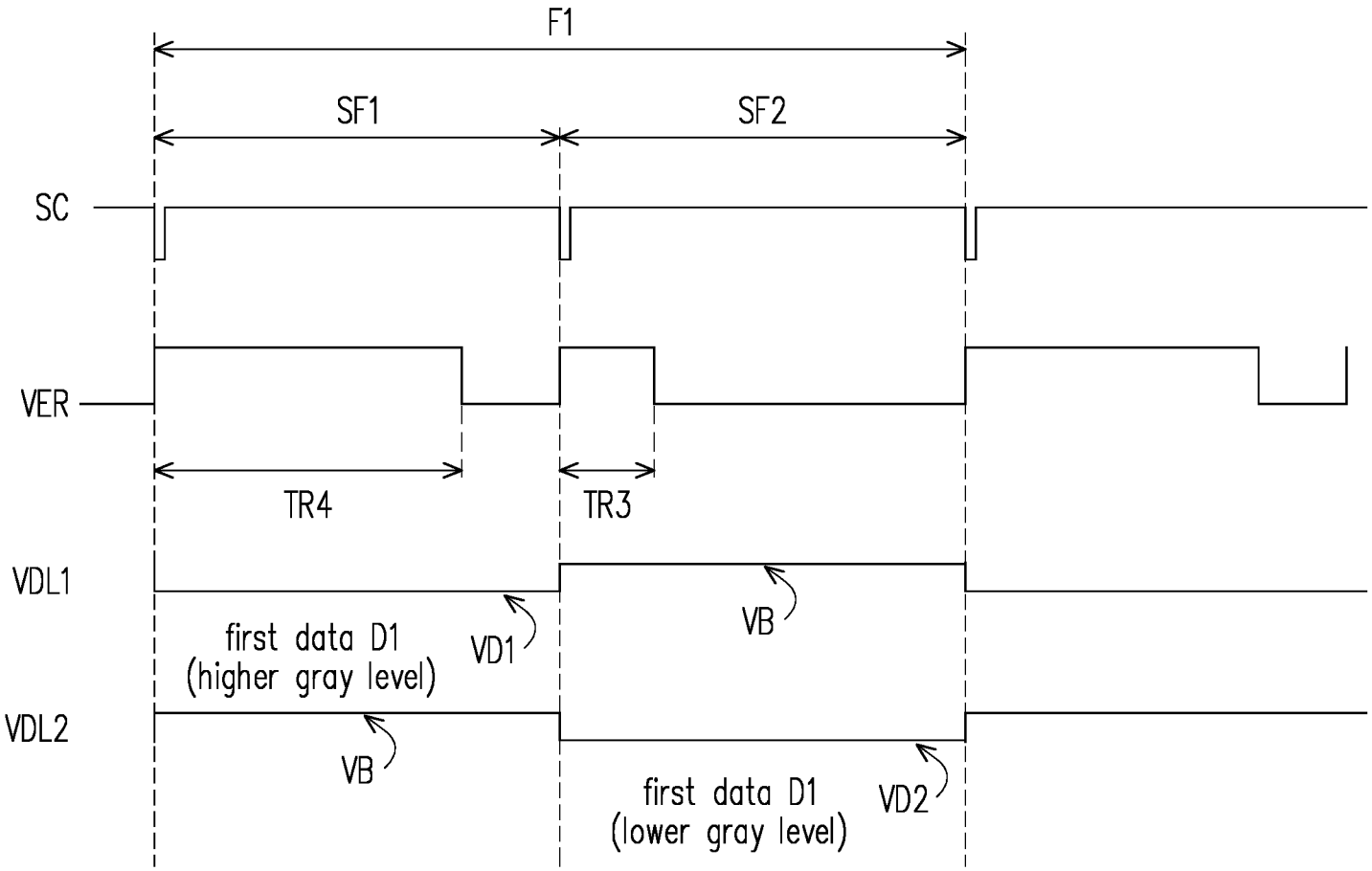
FIG. 4B illustrates a driving waveform corresponding to the pixel illustrated in FIG. 4A.

FIG. 4B illustrates a driving waveform corresponding to the pixel 110 illustrated in FIG. 4A. Signals VSC and VER are voltage signals transmitted on the scan line SC and the erase line ER respectively. A Signal VDL1 is a voltage signal transmitted on the data line DL when the first gray level is determined to be greater than the predetermined gray level. A Signal VDL2 is a voltage signal transmitted on the data line DL when the first gray level is determined to be less than or equal to the predetermined gray level.

The operation waveform as illustrated in FIG. 4B is similar to the operation waveform as illustrated in FIG. 3A, except that the emission signal VEM in FIG. 3A is replaced by the erase signal VER in FIG. 4B.

At beginnings of the first sub-frame time SF1 and the second sub-frame time SF2, the signal VSC is switched to a low voltage level and the transistor P5 is conducted, so the data transmitted from the data line DL is passed to the control terminal of the transistor P4. Then, the signal VER is switched to a high voltage level within a first emission period TR1 and a second emission period TR2 and the transistor P6 is cutoff, so the data transmitted from the data line DL is stored in the capacitor C2. Moreover, the transistor P4 is driven by data stored in capacitor C2 within first emission period TR1 and the second emission period TR2 in order to provide corresponding current levels to the LED LD2. Therefore, the LED LD2 displays within the first emission period TR1 and the second emission period TR2. Since the first driving voltage VD1, the second driving voltage VD2 and the black driving voltage VB in FIGS. 3A and 4B are similar, please refer to related paragraphs above for detailed operations of them, which are omitted herein.

It is noted that the black driving voltage VB as illustrated in FIGS. 3A and 4B are only for exemplary purposes which should not be utilized for limiting scope of the subject disclosure. Of course, people skilled in the art can modify or alter the black driving voltage VB according to different design concepts and system requirements.

Figure 5A:
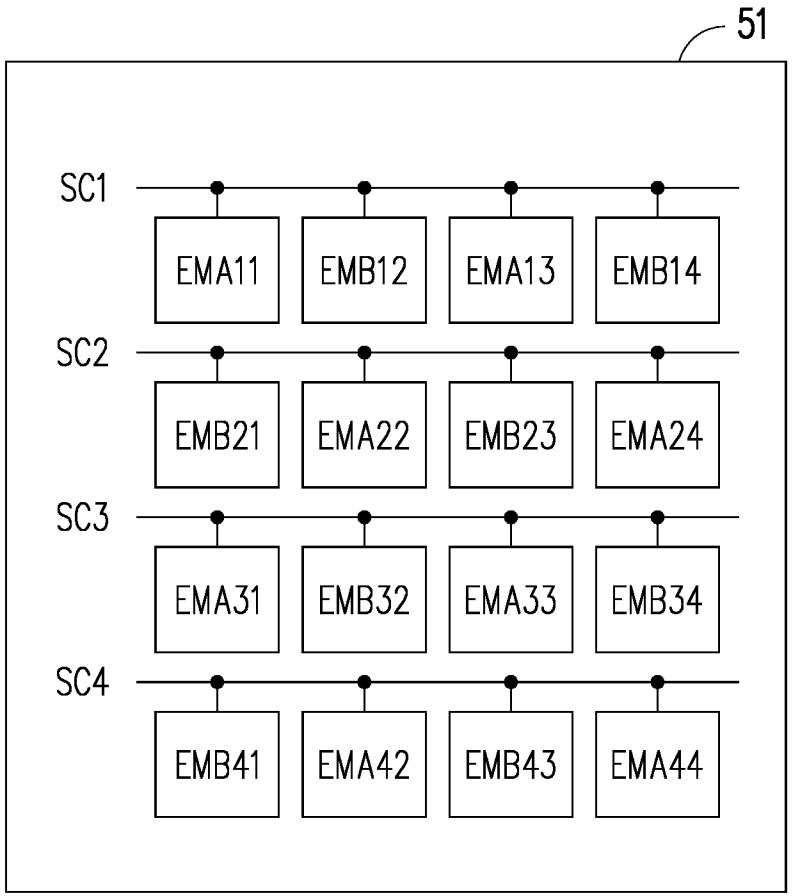
FIG. 5A illustrates a pixel array according to an embodiment of the subject disclosure.

FIG. 5A illustrates a pixel array 51 according to an embodiment of the subject disclosure. The pixels in the pixel array 51 are divided into a first pixel group EMA and a second pixel group EMB. Each pixel of the first pixel group EMA and the second pixel group EMB are arranged alternatively in a row direction and a column direction. For example, the pixel EMA22 is disposed adjacent to the pixels EMB21, EMB23 along the row direction, and the pixel EMA22 is disposed adjacent to the pixels EMB12, EMB32 in the column direction.

Figure 5B:
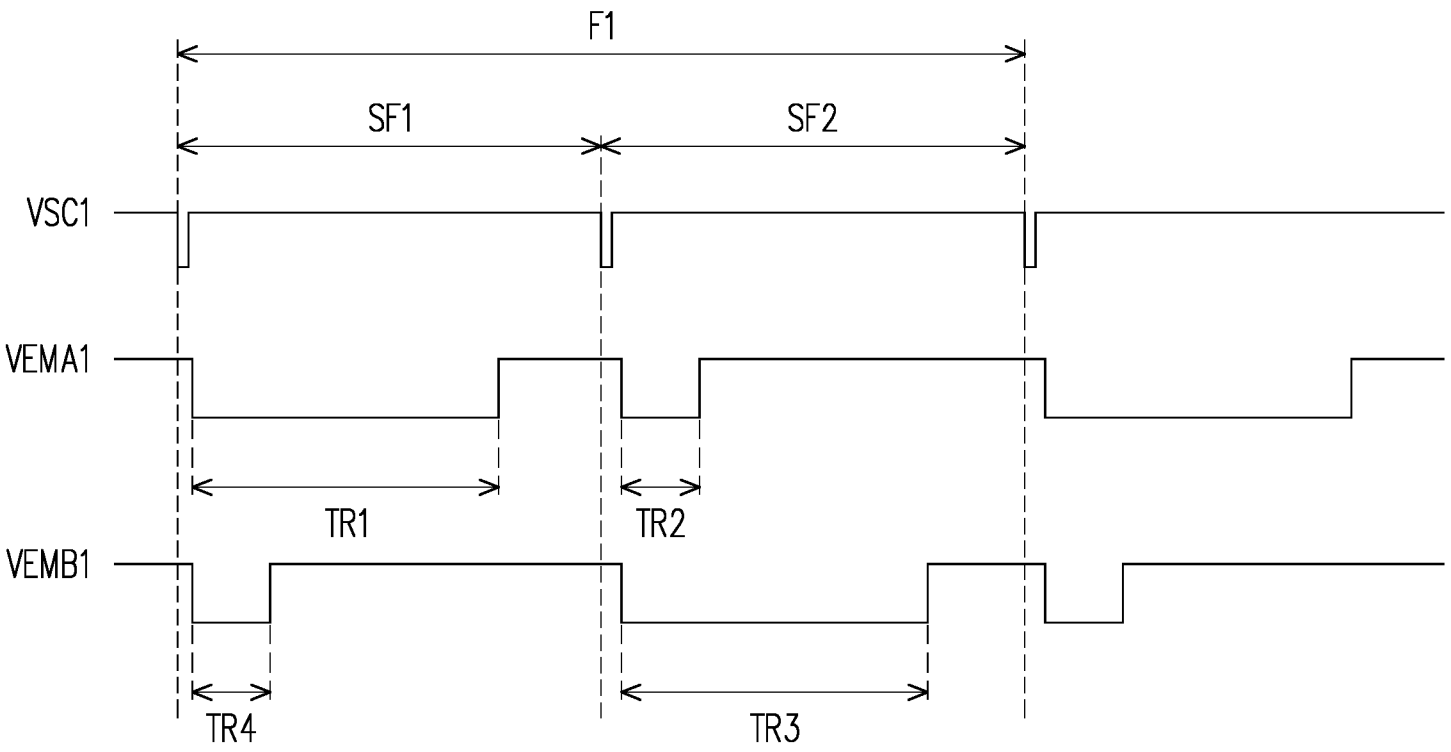
FIG. 5B illustrates a driving waveform corresponding to a first row of the pixel array illustrated in FIG. 5A.

FIG. 5B illustrates a driving waveform corresponding to a first row of the pixel array 51 illustrated in FIG. 5A. Specifically, pixels of the first pixel group EMA have longer lengths of emission periods in the first sub-frame time SF1 but shorter lengths of emission periods in the second sub-frame time SF2. On the other hand, pixels of the second pixel group EMB have shorter lengths of emission period in the first sub-frame time SF1 but longer lengths of emission period in the second sub-frame time SF2.

Taking the pixel EMA11 (e.g. a first pixel EMA11) and the pixel EMB12 (e.g. a second pixel EMB12) in the first row of the pixel array 51 as an example, the driving method of the first pixel EMA11 is similar to the driving method as shown and described in FIG. 3A. That is, when the gray level of the first data D1 is greater than the predetermined gray level, the first pixel EMA11 is controlled to be emitted in the first sub-frame time SF1 for the first emission period TR1. A first current level which follows the first conversion relation R1 is provided to the pixel EMA11 in the second sub-frame time SF2. When the gray level of the first data is less than or equal to the predetermined gray level, the first pixel EMA11 is controlled to be emitted in the second sub-frame time SF2 for the second emission period TR2. A second current level which follows the second conversion relation R2 is provided to the first pixel EMA11 in the second sub-frame time SF2. The time length of the second emission period TR2 can be shorter than the time length of the first emission period TR1.

Referring to FIG. 5B, regarding the second pixel EMB12, a second data with a second gray level is provided to drive the second pixel EMB12 of the display device 1. When the second gray level of the second data is greater than the predetermined gray level, a third current level is provided to the second pixel EMB12 in the second sub-frame time SF2 for a third emission period TR3, and the third current level corresponds to the second gray level according to the first conversion relation R1. A black driving voltage VB can be provided to the second pixel EMB12 in the first sub-frame time SF1.

Referring to FIG. 5B, when the second gray level is less than or equal to the predetermined current level, the second pixel EMB12 is controlled to be emitted in the first sub-frame time SF1 for a fourth emission period TR4. A fourth current level corresponding to the second gray level according to the second conversion relation R2 can be provided to the second pixel EMB12 in the first sub-frame time SF1. A black driving voltage VB can be provided to the second pixel EMB12 in the second sub-frame time SF2. The black data or black current level may be provided to the second pixel EMB12. According to some embodiments, the time length of the fourth emission time TR4 can be shorter than the time length of the third emission time TR3.

According to some embodiment, by means of the driving method of FIG. 5B, when the adjacent pixels have similar gray levels (for example, high gray levels greater than the predetermined gray level), the two adjacent pixels can be emitted in different sub-frame times. Specifically, when the gray levels of data provided to the first pixel EMA11 and the second pixel EMB12 are greater than the predetermined gray level, these two adjacent pixels are emitted in different sub-frame time. That is, the first pixel EMA11 is emitted in the first sub-frame time SF1 and the second pixel EMB12 is emitted in the second sub-frame time SF2. Thus, in some embodiments, the flicker issue can be effectively relieved. In addition, in some embodiments, power requirement of the display device 1 can be alleviated.

Figure 6A:
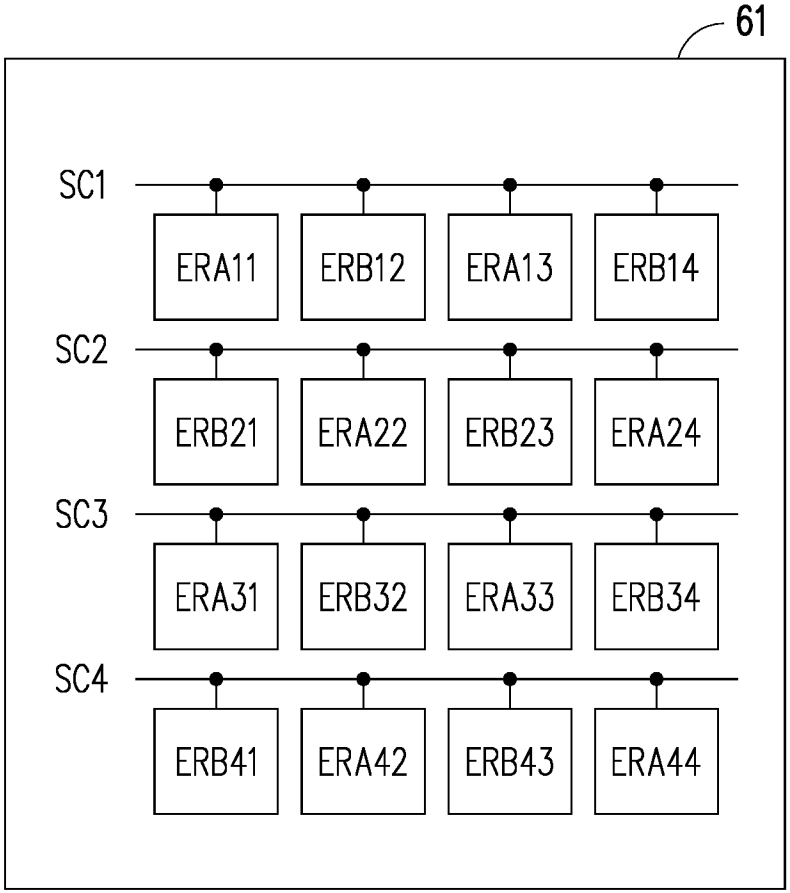
FIG. 6A illustrates another pixel array according to an embodiment of the subject disclosure.

FIG. 6A illustrates another pixel array 61 according to an embodiment of the subject disclosure. The pixels in FIG. 6A may be the pixels as illustrated in FIG. 4A. The pixels in the pixel array 61 are divided into a first pixel group ERA and a second pixel group ERB. Each pixel of the first pixel group ERA and the second pixel group ERB are arranged alternatively in a row direction and a column direction. For example, the pixel ERA22 is disposed adjacent to the pixels ERB21, ERB23 in the row direction, and the pixel ERA22 is disposed adjacent to the pixels ERB12, ERB32 in the column direction.

Figure 6B:
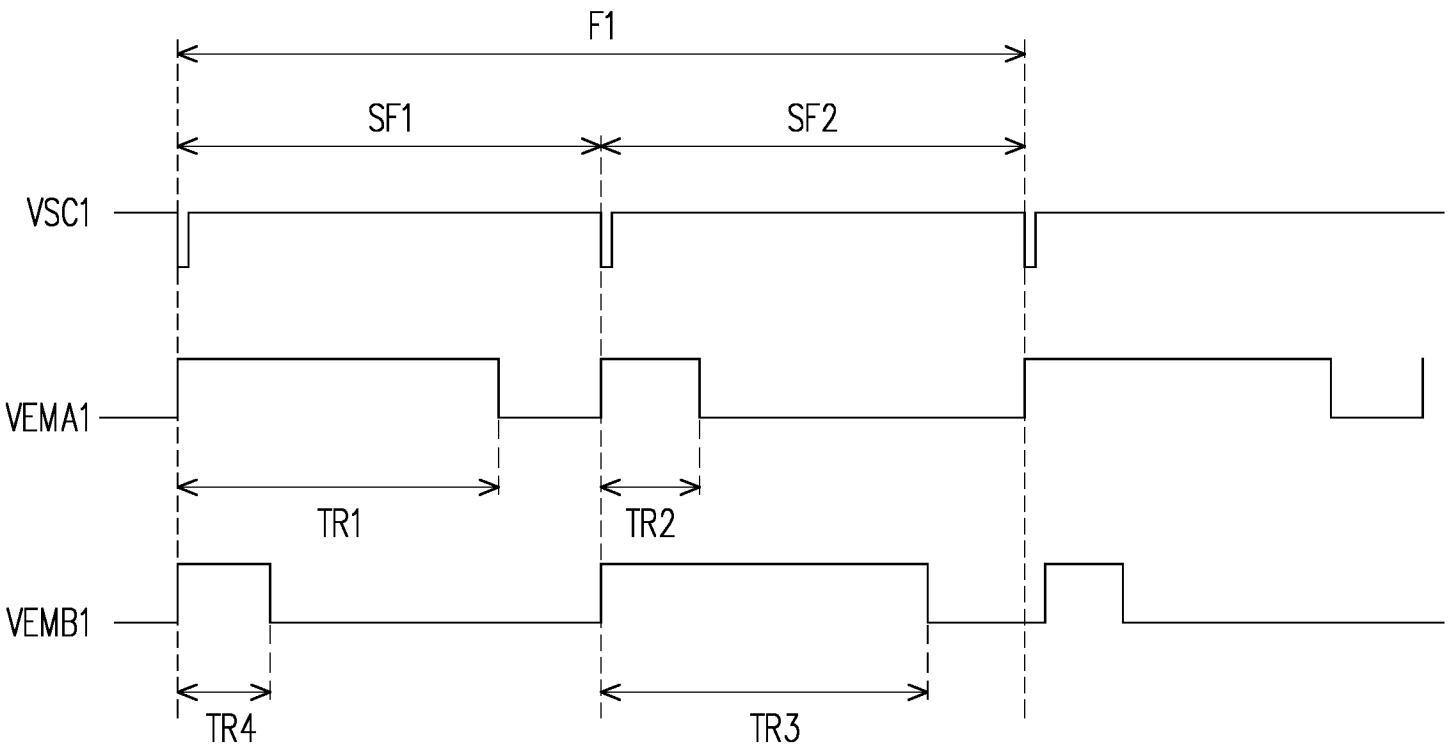
FIG. 6B illustrates a driving waveform corresponding to a first row of the pixel array illustrated in FIG. 6A.

FIG. 6B illustrates a driving waveform corresponding to a first row of the pixel array 61 illustrated in FIG. 6A. Specifically, pixels of the first pixel group ERA have longer lengths of emission periods in the first sub-frame time SF1 but shorter lengths of emission periods in the second sub-frame time SF2. On the other hand, pixels of the second pixel group ERB have shorter lengths of emission period in the first sub-frame time SF1 but longer lengths of emission period in the second sub-frame time SF2. Since FIGS. 5A and 6A share similar arrangements of pixels, please refer to related paragraphs in the above for detailed operations, which are omitted herein.

However, pixels of the first pixel group EMA and the second pixel group EMB are not limited to the arrangements in FIGS. 5A and 6A. People skilled in the art can modify or alter the pixel array 11, 51, 61 and the display device 1 in the above according to different design concept or system requirements.

Figure 7B:
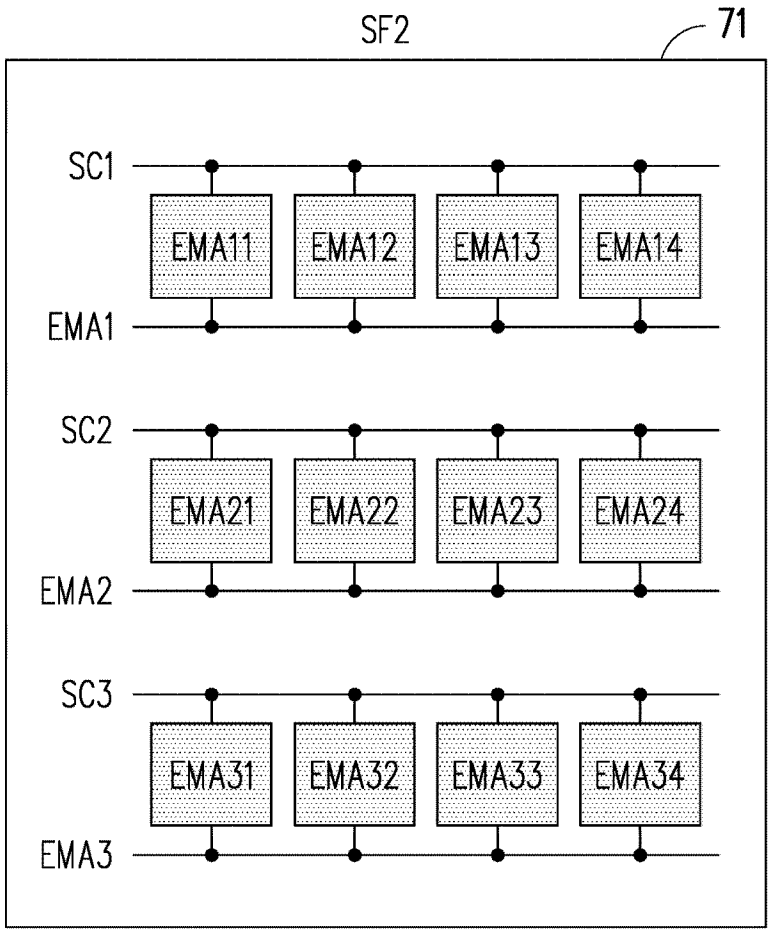
FIGS. 7A and 7B illustrate operations of a pixel array in the first sub-frame time and the second sub-frame time according to an embodiment of the subject disclosure.
Figure 7A:
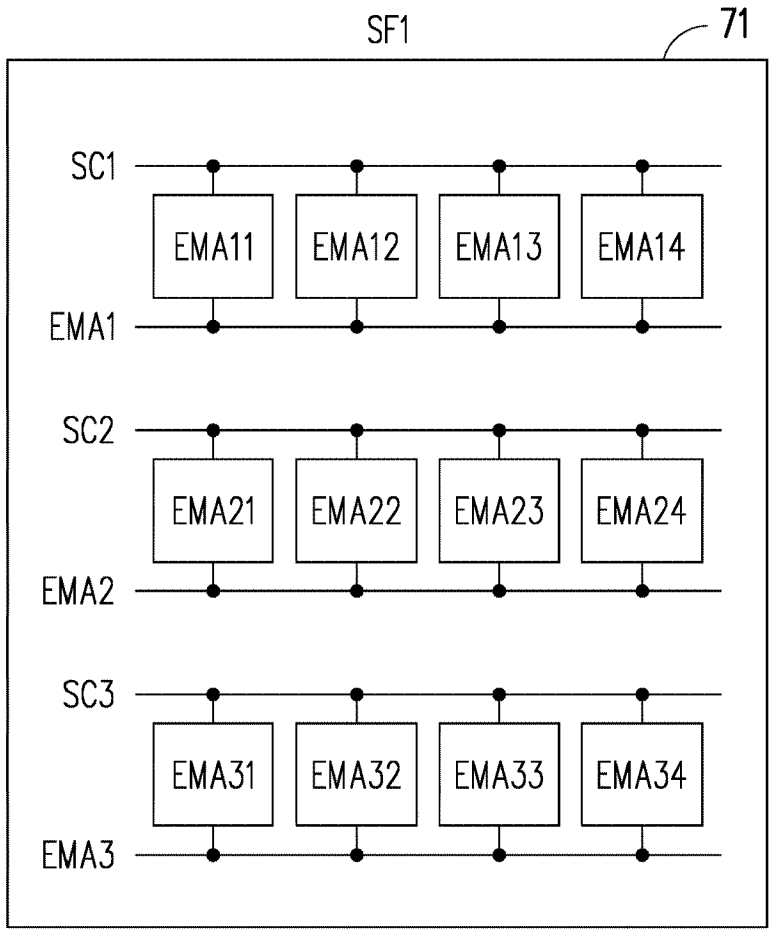

FIGS. 7A and 7B illustrate operations of a pixel array 71 in the first sub-frame time SF1 and the second sub-frame time SF2 according to an embodiment of the subject disclosure. In such embodiment, only pixels EMA11-EMA34 of the first pixel group EMA are utilized. That is, all pixels in the pixel array 71 have the same length of emission periods in the first sub-frame time SF1 and the same length of emission periods in the second sub-frame time SF2. In addition, the mean gray level that all pixels display in the first sub-frame time SF1 is greater than the predetermined gray value, and the mean gray level that all pixels display in the second sub-frame time SF2 is less than or equal to the predetermined gray value.

A scan line SC1 and an emission line EMA1 are connected to the pixels EMA11-EMA14 of the first row. A scan line SC2 and an emission line EMA2 are connected to the pixels EMA21-EMA24 of the second row. A scan line SC3 and an emission line EMA3 are connected to the pixels EMA31-EMA34 of the third row.

Therefore, during the first sub-frame time SF1 as illustrated in FIG. 7A, the pixels EMA11-EMA34 have longer length of emission periods and display data with gray level greater than the predetermined gray level. During the second sub-frame time SF2 as illustrated in FIG. 7B, the pixels EMA11-EMA34 have shorter length of emission periods with gray level less than or equal to the predetermined gray level.

Figure 8B:
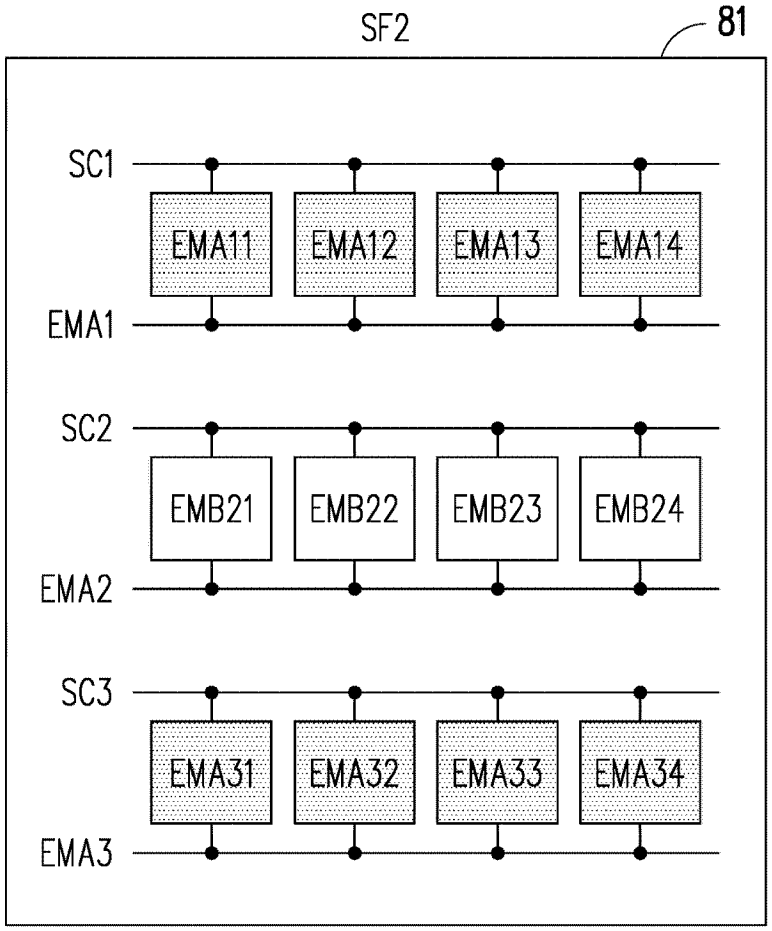
FIGS. 8A and 8B illustrate operations of a pixel array in the first sub-frame time and the second sub-frame time according to an embodiment of the subject disclosure.
Figure 8A:
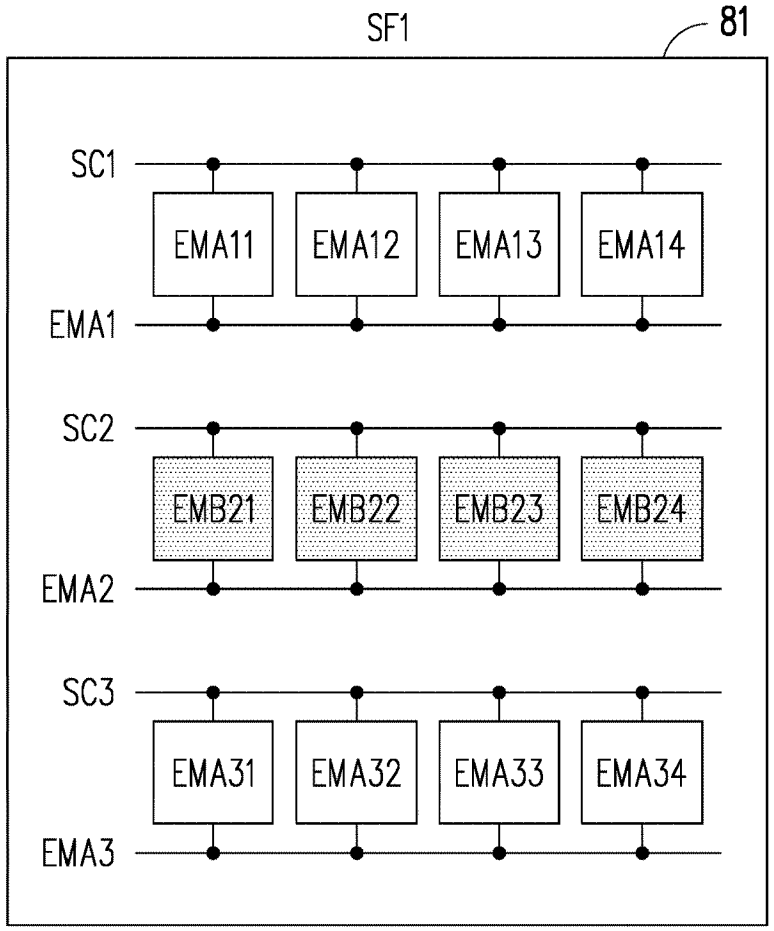

FIGS. 8A and 8B illustrate operations of a pixel array 81 in the first sub-frame time SF1 and the second sub-frame time SF2 according to an embodiment of the subject disclosure. In such embodiment, pixels of the first pixel group EMA and the second pixel group EMB are utilized. Specifically, pixels of the first pixel group EMA and the second pixel group EMB are disposed in different rows of the pixel array 81, and rows formed by the first pixel group EMA and rows formed by the second pixel group EMB are alternately arranged. Therefore, each pixel of the first pixel group EMA is disposed adjacent to at least one pixel of the second pixel group EMB along a column direction. Taking the pixel EMA11 (e.g. the first pixel EMA11) and the pixel EMB21 (e.g. the second pixel EMB21) as an example, the second pixel EMB21 is disposed adjacent to the first pixel EMA11 along a column direction. In addition, the mean gray level that the first pixel EMA11 displays is greater than the predetermined gray value in the first sub-frame time SF1, the mean gray level that the second pixel EMB21 displays in the first sub-frame time SF1 is less than or equal to the predetermined gray value, and vice versa.

Specifically, during the first sub-frame time SF1 as illustrated in FIG. 8A, the pixels EMA11-EMA14, EMA31-EMA34 of the first and third rows have longer length of emission periods and display data with gray level greater than the predetermined gray level in the first sub-frame time SF1. The pixels EMB21-EMB24 of the second row have shorter length of emission periods and a current level which follows the second conversion relation R2 can be provided to the pixels EMB21-EMB24 when the gray level is less than or equal to the predetermined gray level in the first sub-frame time SF1. During the second sub-frame time SF2 as illustrated in FIG. 8B, the pixels EMA11-EMA14, EMA31-EMA34 of the first and third rows have shorter length of emission periods and a current level which follows the second conversion relation R2 can be provided to the pixels EMA11-EMA14, EMA31-EMA34 when the gray level is less than or equal to the predetermined gray level in the second sub-frame time SF2, and the pixels EMB21-EMB24 of the second row have longer length of emission periods and display data with gray level greater than the predetermined gray level in the second sub-frame time SF2.

Figure 9B:
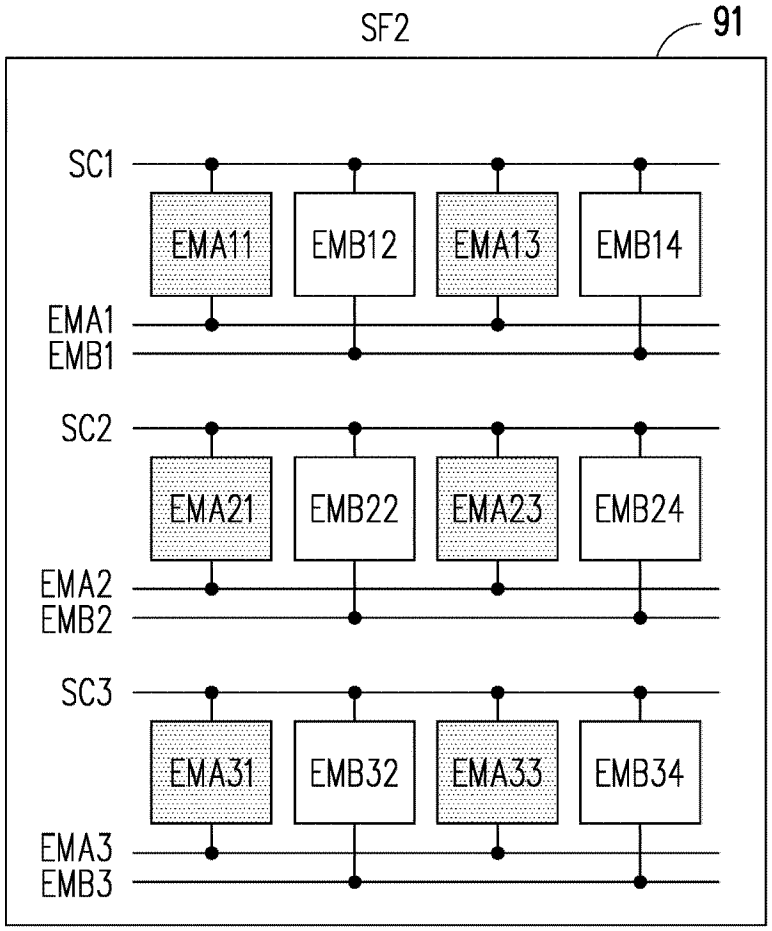
FIGS. 9A and 9B illustrate operations of a pixel array in the first sub-frame time and the second sub-frame time according to an embodiment of the subject disclosure.
Figure 9A:
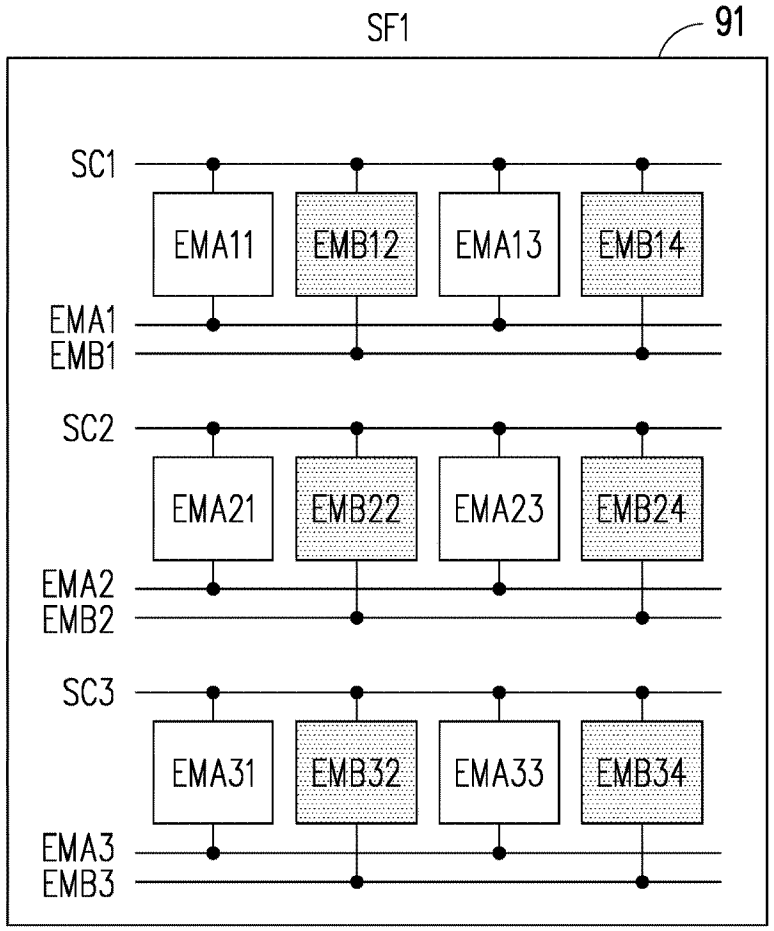

FIGS. 9A and 9B illustrate operations of a pixel array 91 in the first sub-frame time SF1 and the second sub-frame time SF2 according to an embodiment of the subject disclosure. In such embodiment, pixels of the first pixel group EMA and the second pixel group EMB are utilized. Specifically, pixels of the first pixel group EMA and the second pixel group are disposed in different columns of the pixel array 91, and columns formed by the first pixel group EMA and columns formed by the second pixel group EMB are alternatively arranged. Therefore, each pixel of the first pixel group EMA is disposed adjacent to at least one pixel of the second pixel group EMB along a row direction. Taking the pixel EMA11 (e.g. the first pixel EMA11) and the pixel EMB12 (e.g. the second pixel EMB12) as an example, the second pixel EMB12 is disposed adjacent to the first pixel EMA11 along the row direction. In addition, the mean gray level that the first pixel EMA11 displays is greater than the predetermined gray value in the first sub-frame time SF1, the mean gray level that the second pixel EMB21 display in the first sub-frame time SF1 is less than or equal to the predetermined gray value, and vice versa.

Therefore, during the first sub-frame time SF1 as illustrated in FIG. 9A, the pixels EMA11-EMA31, EMA13-EMA33 of the first and third columns have longer length of emission periods and display data with gray level greater than the predetermined gray level, and the pixels EMB12-EMB32, EMB14-EMB34 of the second and fourth columns have shorter length of emission periods and a current level which follows the second conversion relation R2 can be provided to the pixels EMB12-EMB32 and EMB14-EMB34 when the gray level is less than or equal to the predetermined gray level. During the second sub-frame time SF2 as illustrated in FIG. 9B, the pixels EMA11-EMA31, EMA13-EMA33 of the first and third columns have shorter length of emission periods and a current level which follows the second conversion relation R2 can be provided to the pixels EMA11-EMA31, EMA13-EMA33 when the gray level is less than or equal to the predetermined gray level, and the pixels EMB12-EMB32, EMB14-EMB34 of the second and fourth columns have longer length of emission periods and display data with gray level greater than the predetermined gray level.

Figure 10B:
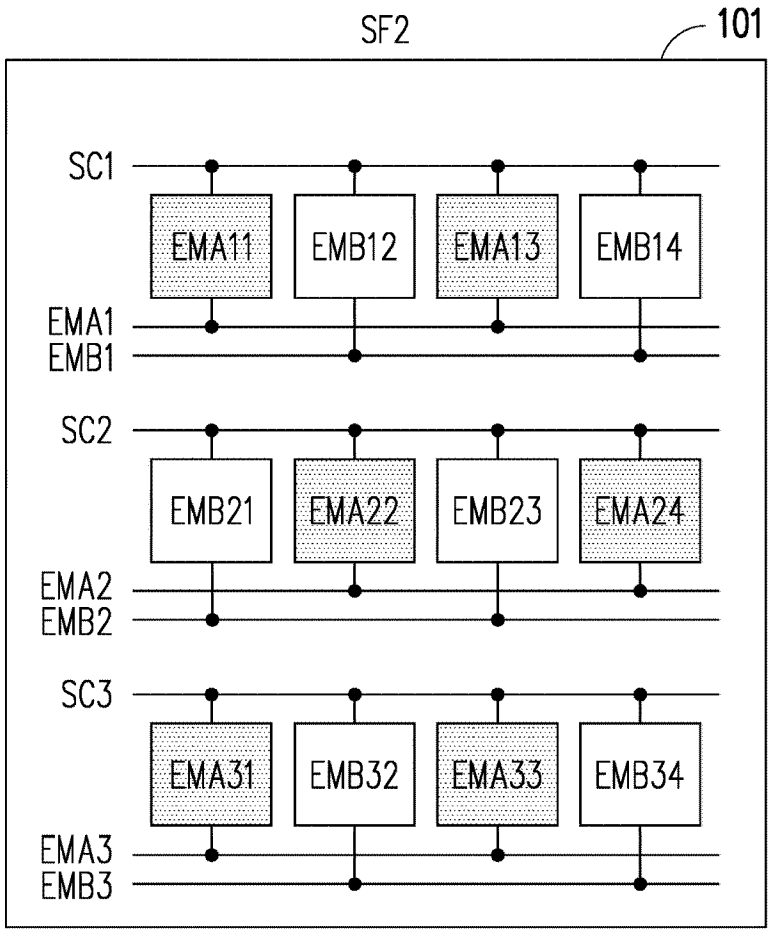
FIGS. 10A and 10B illustrate operations of a pixel array in the first sub-frame time and the second sub-frame time according to an embodiment of the subject disclosure.
Figure 10A:
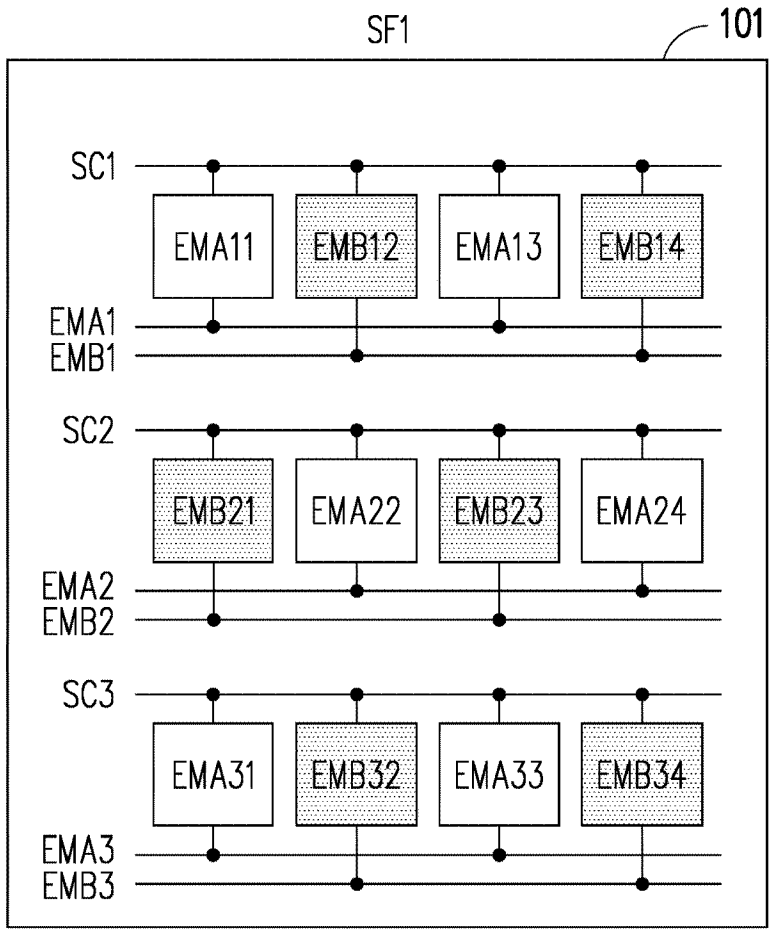

FIGS. 10A and 10B illustrate operations of a pixel array 101 in the first sub-frame time SF1 and the second sub-frame time SF2 according to an embodiment of the subject disclosure. In such embodiment, pixels of the first pixel group EMA and the second pixel group EMB are utilized. Specifically, pixels of the first pixel group EMA and the second pixel group EMB are disposed alternatively both in a row direction and a column direction. Taking the pixel EMA22 (e.g. the first pixel EMA22) and the pixels EMB12, EMB21, EMB23, EMB32 (e.g. the second pixels EMB12, EMB21, EMB23, EMB32) as an example, the first pixel EMA22 is disposed adjacent to the second pixel EMB12, EMB21, EMB23, EMB32 along the row direction and the row direction. In addition, the length of emission period of the first pixel EMA22 is different from that of the second pixels EMB12, EMB21, EMB23, EMB32. Besides, the mean gray level that the first pixel EMA22 displays is greater than the predetermined gray value in the first sub-frame time SF1, the mean gray level that the second pixels EMB12, EMB21, EMB23, EMB32 displays in the first sub-frame time SF1 is less than or equal to the predetermined gray value, and vice versa.

Therefore, during the first sub-frame time SF1 as illustrated in FIG. 10A, the pixels EMA11, EMA13, EMA22, EMA24, EMA31, EMA33 have longer length of emission periods and display data with gray level greater than the predetermined gray level, and the pixels EMB12, EMB14, EMB21, EMB23, EMB32, EMB34 have shorter length of emission periods and a current level which follows the second conversion relation R2 can be provided to the pixels EMB12, EMB14, EMB21, EMB23, EMB32, EMB34 when the gray level is less than or equal to the predetermined gray level. During the second sub-frame time SF2 as illustrated in FIG. 10B, the pixels EMA11, EMA13, EMA22, EMA24, EMA31, EMA33 have shorter length of emission periods and a current level which follows the second conversion relation R2 can be provided to the pixels EMA11, EMA13, EMA22, EMA24, EMA31, EMA33 when the gray level is less than or equal to the predetermined gray level, and the pixels EMB12, EMB14, EMB21, EMB23, EMB32, EMB34 have longer length of emission periods and display data with gray level greater than the predetermined gray level.

Figure 11B:
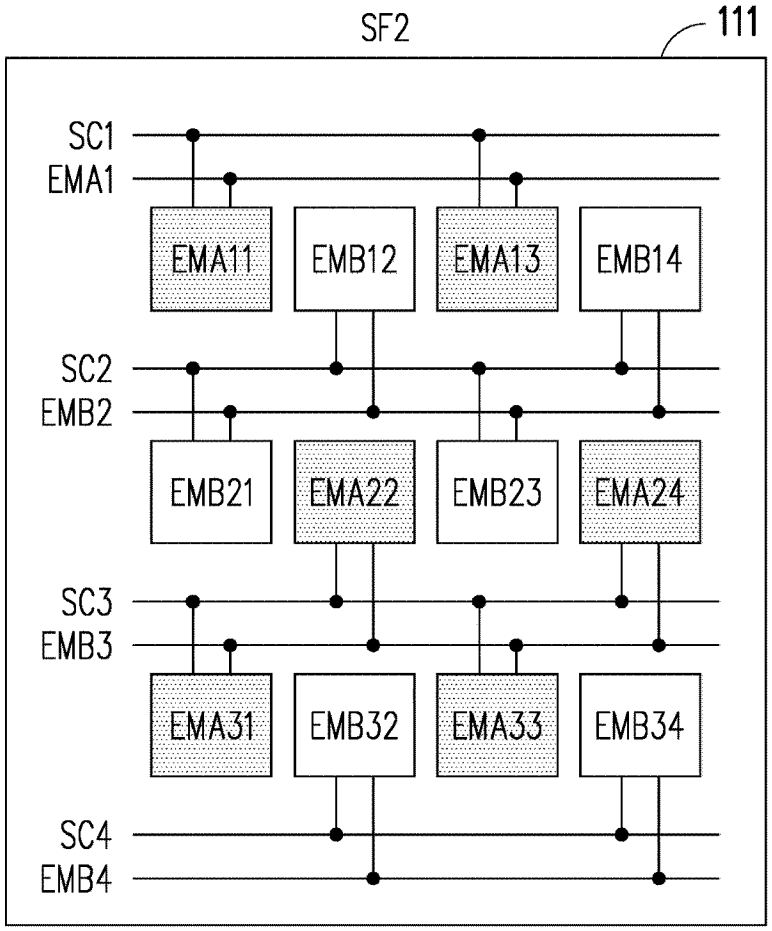
FIGS. 11A and 11B illustrate operations of a pixel array in the first sub-frame time and the second sub-frame time according to an embodiment of the subject disclosure.
Figure 11A:
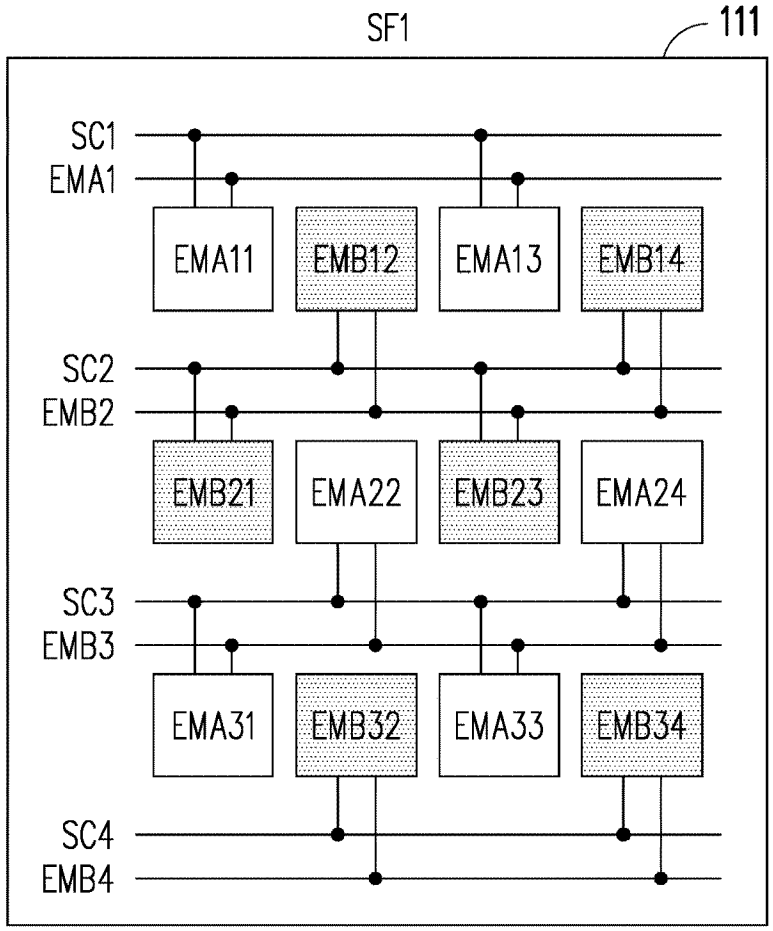

FIGS. 11A and 11B illustrate operations of a pixel array 111 in the first sub-frame time SF1 and the second sub-frame time SF2 according to an embodiment of the subject disclosure. The pixel array 111 as illustrated in FIGS. 11A and 11B is similar to the pixel array 101 as illustrated in FIGS. 10A and 10B, except that the pixel array 111 and the pixel array 101 have different arrangements of the scan lines and the emission lines. In such embodiment, only one emission line is disposed between each row of the pixel array 111. Specifically, a scan line SC1 and an emission line EMA1 are disposed on top of the pixel array 111 and connected to the pixels EMA11, EMA13 of the first pixel group EMA in the first row. A scan line SC2 and an emission line EMB2 are disposed between the first and second rows of the pixel array 111 and connected to the pixels EMB12, EMB14, EMB21, EMB23 of the second pixel group EMB in the first and second rows. A scan line SC3 and an emission line EMA3 are disposed between the second and third rows of the pixel array 111 and connected to the pixels EMA22, EMA24, EMA31, EMA33 of the first pixel group EMA in the second and third rows. A scan line SC4 and an emission line EMB4 disposed on bottom of the pixel array 111 and are connected to the pixel EMB32 and EMB34 of the second pixel group EMB in the third row. Taking the first and second rows in the pixel array 111 as an example, only one emission line EMB2 is disposed between the first and second rows of the pixel array 111. Specifically, the emission line EMB2 can be shared to the pixels EMB12, EMB14, EMB21, EMB23 of the second pixel group EMB in the first and second rows. Therefore, a number of total signal lines can be effectively reduced, thereby saving area consumption of the pixel array 111.

The operations of the pixel array 111 in the first sub-frame time SF1 and the second sub-frame time SF2 are similar to that of the pixel array 101, so please refer to corresponding paragraphs related to the pixel array 101 in the above for details, which is omitted herein.

In summary, according some embodiments, a frame time of the display device is divided into a first sub-frame time and a second sub-frame time. A pixel in the display device is controlled to be emitted in the first sub-frame time or the second sub-frame time which have different lengths of emission periods. According to some embodiment, when the gray level of the data is less than or equal to a predetermined gray level, the current level can follow the second conversion relation to result in a higher current level, and the higher current level can be provided to the pixel in the second sub-frame time for a shorter length of emission period. Thus, display image quality of the display device in low gray level can be effectively improved.

What is claimed is:

1. A driving method, adapted to drive a first pixel and a second pixel of a display device to display an image in a frame time, the driving method comprising:

dividing the frame time into a first sub-frame time and a second sub-frame time;

providing a first data with a first gray level;

providing a second data with a second gray level to drive the second pixel disposed adjacent to the first pixel; and controlling the first pixel to be emitted in the first sub-frame time or the second sub-frame time according to the first data, wherein when the first gray level is greater than a predetermined gray level, controlling the first pixel to be emitted in the first sub-frame time, and when the first gray level is less than or equal to the predetermined gray level, controlling the first pixel to be emitted in the second sub-frame time, controlling the second pixel to be emitted in the first sub-frame time or the second sub-frame time according to the second data, wherein when the second gray level is greater than the predetermined gray level, controlling the second pixel to be emitted in the second sub-frame time, and when the second gray level is less than or equal to the predetermined gray level, controlling the second pixel to be emitted in the first sub-frame time.

2. The driving method of claim 1, wherein the step of controlling the first pixel to be emitted in the first sub-frame time or the second sub-frame time according to the first data comprises:

when the first gray level is greater than the predetermined gray level, controlling the first pixel to be emitted in the first sub-frame time for a first emission period, and when the first gray level is less than or equal to the predetermined gray level, controlling the first pixel to be emitted in the second sub-frame time for a second emission period, wherein a time length of the first emission period and a time length of the second emission period are different.

3. The driving method of claim 2, wherein the time length of the second emission period is shorter than the time length of the first emission period.

4. The driving method of claim 1, wherein the step of controlling the second pixel to be emitted in the first sub-frame time or the second sub-frame time according to the second data comprises:

when the second gray level is greater than the predetermined gray level, controlling the second pixel to be emitted in the second sub-frame time for a third emission period, and when the second gray level is less than or equal to the predetermined gray level, controlling the second pixel to be emitted in the first sub-frame time for a fourth emission period, wherein a time length of the third emission period and a time length of the fourth emission period are different.

5. The driving method of claim 4, wherein the time length of the fourth emission period is shorter than the time length of the third emission period.

6. The driving method of claim 1, wherein the step of controlling the second pixel to be emitted in the first sub-frame time or the second sub-frame time according to the second data comprises:

when the second gray level of the second data is greater than the predetermined gray level, providing a third current level corresponding to the second gray level according to a first conversion relation to the second pixel in the second sub-frame time, and when the second gray level of the second data is less than or equal to the predetermined gray level, providing a fourth current level corresponding to the second gray level according to a second conversion relation to the second pixel in the first sub-frame time, wherein the first conversion relation and the second conversion relation are different.

7. The driving method of claim 1, wherein the second pixel is disposed adjacent to the first pixel along a column direction.

8. The driving method of claim 1, wherein the second pixel is disposed adjacent to the first pixel along a row direction.

9. The driving method of claim 1, wherein when the first gray level of the first data is greater than the predetermined gray level, providing a black data to the first pixel in the second sub-frame time.

10. The driving method of claim 1, wherein when the first gray level of the first data is less than or equal to the predetermined gray level, providing a black data to the first pixel in the first sub-frame time.

11. The driving method of claim 1, wherein when the first gray level is greater than the predetermined gray level, providing a first current level corresponding to the first gray level to the first pixel according to a first conversion relation, when the first gray level is less than or equal to the predetermined gray level, providing a second current level corresponding to the first gray level to the first pixel according to a second conversion relation, wherein the first conversion relation and the second conversion relation are regarding relations between a current level and a gray level.

12. The driving method of claim 11, wherein the second conversion relation has a greater slope than the first conversion relation.

13. The driving method of claim 11, wherein for the same current, a corresponding gray level in the first conversion relation is greater than a corresponding gray level in the second conversion relation.

* * * * *